US005439349A

United States Patent [19]

Kupferberg

[11] Patent Number: 5,439,349

[45] Date of Patent: Aug. 8, 1995

[54] EXHAUST FAN APPARATUS

[76] Inventor: Minel Kupferberg, 5862 Ferncroft, Hampstead, Quebec, Canada, H3X 1C7

[21] Appl. No.: 340,894

[22] Filed: Nov. 15, 1994

[51] Int. Cl.[6] ..... F04D 29/44

[52] U.S. Cl. ..... 415/212.1; 454/3; 417/198

[58] Field of Search ..... 415/212.1, 224.5, 206; 454/3, 36, 39; 417/198

[56] References Cited

U.S. PATENT DOCUMENTS

| | | | |
|---|---|---|---|
| 352,597 | 11/1886 | Wohlfert | 454/39 |
| 2,265,112 | 12/1941 | Davies | 415/212.1 |
| 3,385,197 | 5/1968 | Greber | 454/39 |
| 3,719,032 | 3/1973 | Cash | 55/264 |
| 3,797,373 | 3/1974 | Larson | 415/212.1 |
| 4,806,076 | 2/1989 | Andrews | 415/209 |

*Primary Examiner*—Edward K. Look
*Assistant Examiner*—Michael S. Lee
*Attorney, Agent, or Firm*—Samuel Meerkreebs

[57] ABSTRACT

An exhaust fan to be mounted on a roof and for exhausting spent gases from a building, including a centrifugal fan scroll casing with a centrifugal fan impeller mounted on an axle within the casing and having an axis of rotation at right angles to the side members of the scroll casing. A bifurcated stack including two generally parallel passageways is connected to the scroll casing so that the stack is upright and communicates with the outlet port of the scroll casing. A ring defining an annulus may be provided at the outlet end of the stack to induce ambient air to mix with the spent air exhausting from the bifurcated tubular member.

5 Claims, 3 Drawing Sheets

Fig. 4
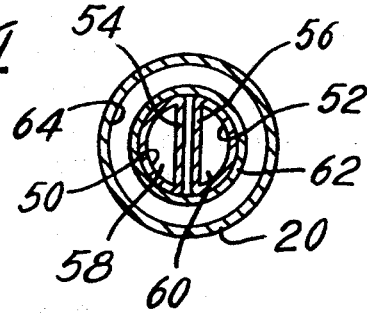
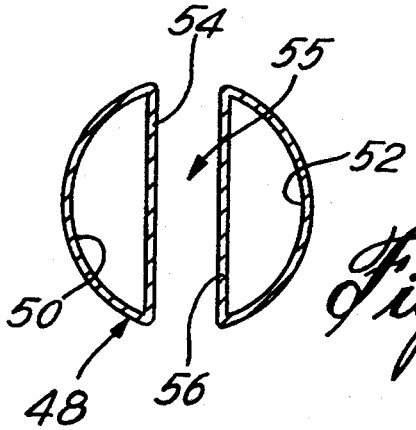
Fig. 5
Fig. 3
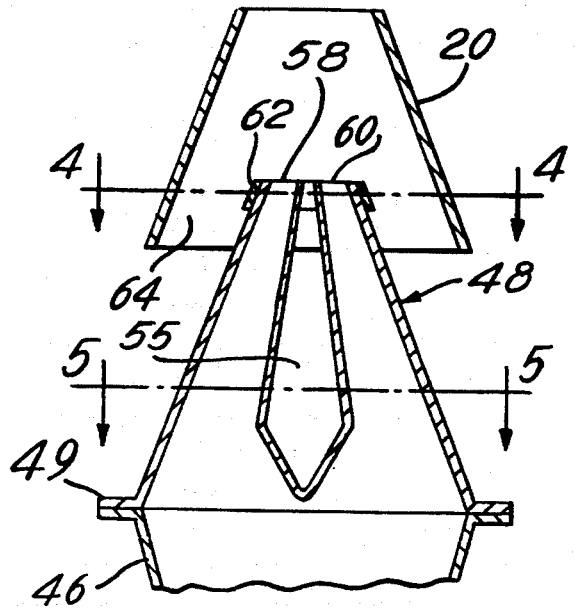

EXHAUST FAN APPARATUS

BACKGROUND OF THE INVENTION

1. Field of the Invention

The present invention relates to ventilation fans, and in particular, high velocity exhaust fans for exhausting atmosphere containing airborne contaminants to be diluted by ambient air.

2. Description of the Prior Art

An "upblast" fan is described in U.S. Pat. No. 4,806,076, Andrews, issued Feb. 21, 1989. The exhaust fan described in this patent has a lower portion and an upper portion with a radial fan in the lower portion. The upper portion of the housing includes two somewhat parallel passageways defining first and second flow paths. The walls forming these passageways are shaped as sectors of conical sections. A wind band is provided at the top end of the two passages at the outlets thereof to provide an entrainment of fresh air to mix with the gases exhausting from the two passageways. Access to the fan motor is centrally through the gap formed in the upper portion between the walls forming the two passageways. Although ventilation fans in accordance with U.S. Pat. No. 4,806,076 are acknowledged to be an improvement over the prior art fans, there are constraints in the design of the fan which limit the performance and efficiency thereof. For instance, the diameter of the radial fan is limited as well as the motor size. The diffuser efficiency is also limited due to the limited space at the periphery of the radial fan.

SUMMARY OF THE INVENTION

It is an aim of the present invention to provide an improved ventilation fan apparatus with increased capacity, performance, and flexibility.

It is a further aim of the present invention to provide a fan housing with easier accessibility to the fan and fan motor for maintenance thereof.

A construction in accordance with the present invention comprises an exhaust fan apparatus comprising a housing having an upper portion and a lower portion, wherein the lower portion includes a centrifugal fan scroll casing having an axis which is the axis of rotation of the fan impeller. The upper portion includes a first tubular diffuser portion communicating with the fan outlet and a second tubular portion extending upwardly from the first tubular portion which is bifurcated to provide two passageways having generally parallel axes, generally right angle to the axis of the fan, and wherein the axes of the passageways lie in a plane which is parallel to the axis of the fan.

In a more specific embodiment, a second tubular portion includes a pair of spaced-apart outlets corresponding to the two passageways, and a ring surrounds the second tubular portion at the level of the outlets to form an annulus, whereby ambient air is induced through the annulus to mix with the gases exhausting from the passageway.

In a still more specific embodiment, the scroll casing is provided with a fan inlet which extends axially relative to the fan axis. The exhaust fan apparatus is installed on the roof of a building and is in communication with duct means exhausting spent air from the interior of the building.

The present invention permits a more flexible and efficient construction compared to the prior art. For instance, the diffuser of the centrifugal fan is more efficient with fluid flow directed to the axes of the passageways.

BRIEF DESCRIPTION OF THE DRAWINGS

Having thus generally described the nature of the invention, reference will now be made to the accompanying drawings, showing by way of illustration, a preferred embodiment thereof, and in which:

FIG. 3 is a fragmentary vertical cross-section of a detail of the embodiment shown in FIG. 1;

FIG. 4 is a horizontal cross-section taken along line 4—4 of FIG. 3; and FIG. 5 is a horizontal cross-section taken along line 5—5 of FIG. 3.

DESCRIPTION OF THE PREFERRED EMBODIMENTS

Figure 1:
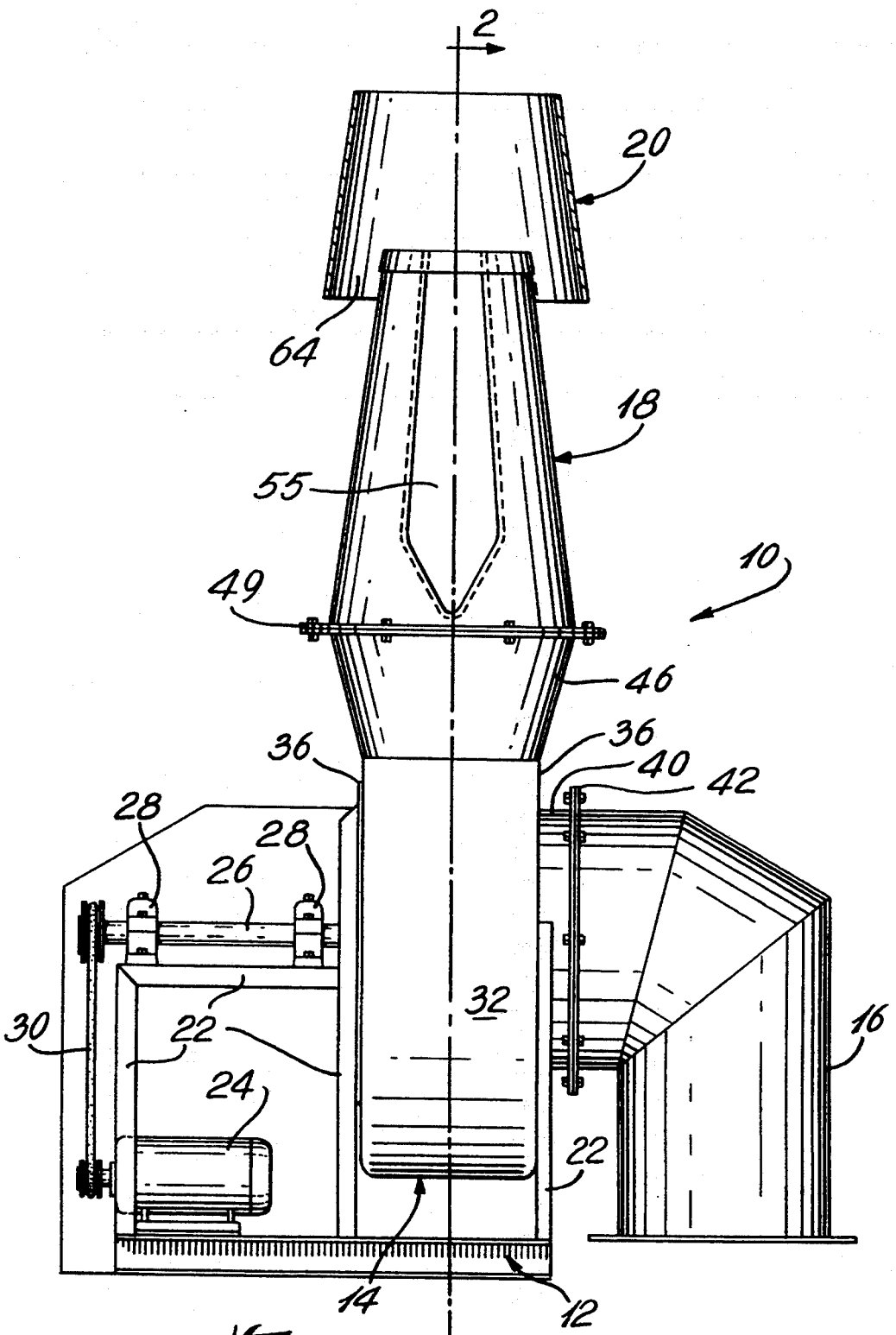
FIG. 1 is a front elevation of an exhaust fan in accordance with the present invention.

Referring now to the drawings, there is shown an exhaust fan apparatus 10 having a base 12 meant to be mounted on a roof, a centrifugal fan casing 14 mounted on the base 12, and an inlet duct 16 extending to one side of the casing 14 from the interior of a building (not shown). Mounted to the top of the centrifugal fan casing 14 is an exhaust stack 18, and topping the exhaust stack is a ring 20 of frusto-conical shape.

Figure 2:
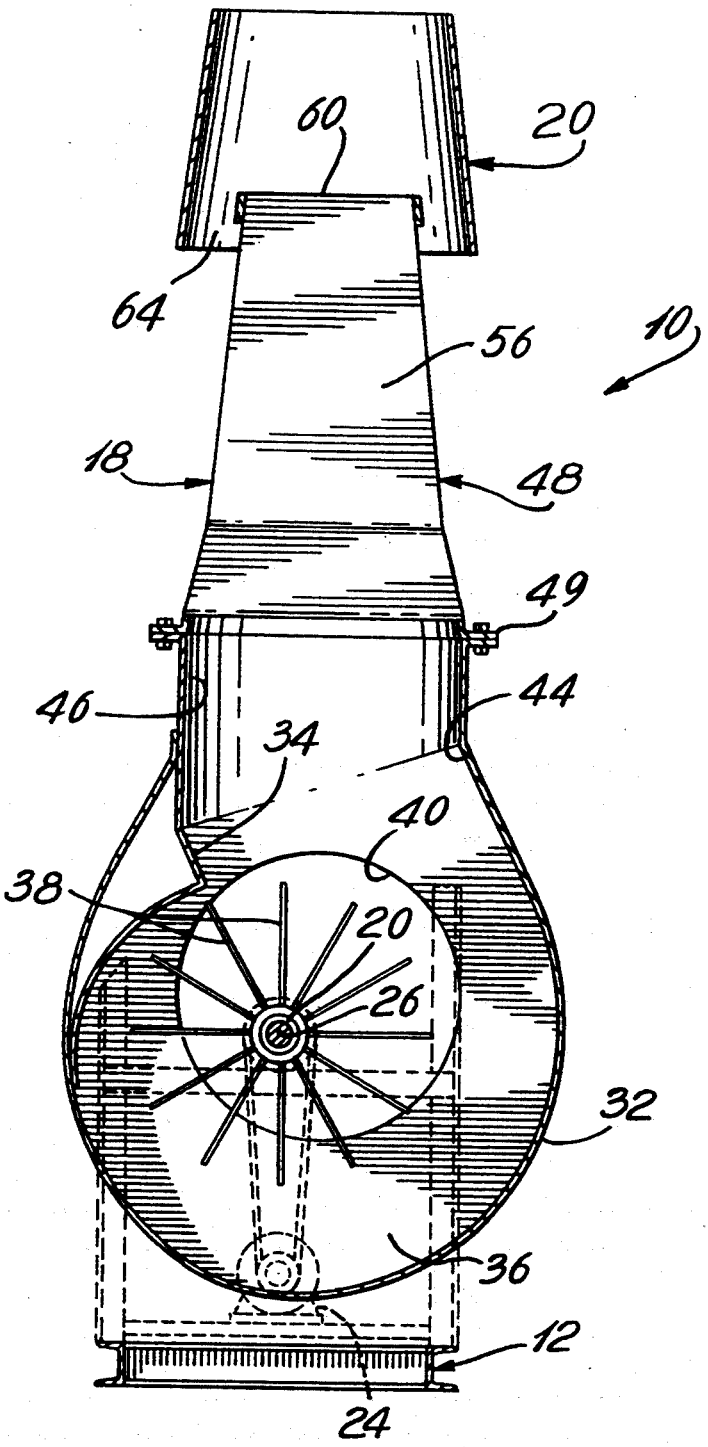
FIG. 2 is a vertical cross-section taken along line 2—2 of FIG. 1.

The base 12 includes a frame 22 on which a motor 24 is mounted. A shaft 26 is journaled in bearing brackets 28 mounted on the frame 22 and extends within the casing 32 in a cantilevered manner. The shaft 26 is driven by a drive belt 30 taken off the motor 24. As shown in FIG. 2, shaft 26 mounts a centrifugal impeller 38 having multiple vanes rotating about the axis of the shaft 26.

The casing 14 includes a scroll 32 surrounding the impeller 38 and interrupted by discharge port 44. The scroll 32 includes a cut-off 34 near the discharge port 44. The casing 14 also includes parallel side walls 36. An inlet port 40 is defined on one side wall 36 of the casing 14, and connector flanges 42 are provided to fasten the inlet port 40 with the inlet duct 16.

Thus, the spent gases containing airborne contaminants exhausting from the building through the duct 16 enter the casing 14 axially relative to the impeller 38, and the air flow is accelerated through the discharge port 44. A diffuser tube 46 is mounted to and communicates with the discharge port 44. The diffuser tube 46 is in turn connected to the bifurcated duct 48 by means of connecting flanges 49. The bifurcated duct 48 includes passageways 50 and 52 which are generally parallel although they, in fact, converge slightly towards the outlet. A central opening 55 is formed by means of inner flat walls 54 and 56 defining the passageways 50 and 52 respectively.

Outlet ports 58 and 60 are defined at the upper end of the bifurcated duct 48, communicating with passageways 50 and 52 respectively. An annular ring 62 extends about the upper end of the bifurcated duct 48.

An annulus 64 is formed between the ring 20 and the ring 62.

In operation, the impeller 38, driven by motor 24, will draw the exhaust gases from the building containing airborne contaminants through the duct 16 and then upwardly into the stack 18 by first passing through the diffuser and then the double passageways 50 and 52. The location of the casing 14 and, in particular, the orientation of the scroll 32 relative to the stack 18, permits even distribution of the air flow into the diffuser and through the passageways 50 and 52. The spent gases exhaust through the outlet ports 58 and 60 at relatively high velocity and cause ambient air to be induced into the annulus 64 to mix with the airborne contaminants and, therefore, dilute the exhaust.

I claim:

1. An exhaust fan apparatus comprising a housing having an upper portion and a lower portion, wherein the lower portion includes a centrifugal fan scroll casing, the scroll casing having parallel side walls, a shaft extending within the casing normal to the side wall and mounting an impeller for rotation therewithin, motor means for driving the shaft, an inlet port provided axially of the fan shaft axis on a side wall of the casing, a discharge port extending from the scroll, a first tubular diffuser portion communicating with the fan discharge port and a second tubular portion extending upwardly from the first tubular portion, the second tubular portion being bifurcated to provide at least two passageways having generally parallel axes generally normal to the axis of the fan shaft, and wherein the axes of the passageways lie in a plane which is parallel to the axis of the fan.

2. An exhaust fan apparatus as defined in claim 1, wherein the second tubular portion includes a pair of spaced-apart outlet ports corresponding to the two passageways, and a ring surrounds the second tubular portion at the level of the outlet ports to form an annulus therewith, whereby ambient air is induced through the annulus to mix with the gases exhausting from the passageway.

3. An exhaust fan apparatus as defined in claim 2, wherein the second tubular member is of frusto-conical cross-section but includes a central gap defined by opposed flat wall members defining the two respective passageways.

4. An exhaust fan apparatus as defined in claim 3, wherein the diffuser is an inverted frusto-conical tube extending from the outlet discharge port of the scroll casing.

5. An exhaust fan apparatus as defined in claim 1, wherein the plane containing the axes of the passageways also contains the axis of the fan shaft.

* * * * *